US007893617B2

(12) United States Patent
Sommerer et al.

(10) Patent No.: US 7,893,617 B2
(45) Date of Patent: Feb. 22, 2011

(54) METAL ELECTRODES FOR ELECTRIC PLASMA DISCHARGE DEVICES

(75) Inventors: Timothy John Sommerer, Ballston Spa, NY (US); David John Smith, Clifton Park, NY (US)

(73) Assignee: General Electric Company, Niskayuna, NY (US)

( * ) Notice: Subject to any disclaimer, the term of this patent is extended or adjusted under 35 U.S.C. 154(b) by 898 days.

(21) Appl. No.: 11/365,408

(22) Filed: Mar. 1, 2006

(65) Prior Publication Data

US 2007/0205723 A1 Sep. 6, 2007

(51) Int. Cl.
*H01J 11/00* (2006.01)
*H01J 17/00* (2006.01)

(52) U.S. Cl. ..... 313/574; 313/575; 313/568; 313/608; 313/623; 313/631; 313/577

(58) Field of Classification Search ..... 313/568, 313/571, 578, 608, 613–618, 627–628, 631–633, 313/637–643, 577
See application file for complete search history.

(56) References Cited

U.S. PATENT DOCUMENTS 2,034,571 A 3/1936 Found
2,249,672 A 7/1941 Spanner
2,252,474 A 8/1941 Spanner
2,306,925 A 12/1942 Aicher
2,313,646 A * 3/1943 Johnson ..... 313/572
2,363,531 A 11/1944 Johnson
2,496,374 A 2/1950 Boucher et al.
3,121,184 A * 2/1964 Fox ..... 313/614
3,243,632 A * 3/1966 White ..... 313/629
3,937,996 A 2/1976 Cap
4,117,374 A * 9/1978 Witting ..... 315/99
4,383,197 A * 5/1983 Gungle et al. ..... 313/38
5,107,183 A * 4/1992 Yamamoto et al. ..... 315/209 R
5,550,431 A * 8/1996 Duggan et al. ..... 313/630
5,585,694 A * 12/1996 Goldburt et al. ..... 313/491
5,712,531 A * 1/1998 Rademacher et al. ..... 313/631
5,905,339 A 5/1999 Chow et al.
5,962,977 A * 10/1999 Matsumoto et al. ..... 313/633
6,034,470 A 3/2000 Vollkommer et al.
6,037,714 A * 3/2000 Mehrotra et al. ..... 313/631
6,057,635 A * 5/2000 Nishimura et al. ..... 313/25
6,097,152 A * 8/2000 Nieda ..... 313/632
6,107,737 A * 8/2000 della Porta ..... 313/556
6,356,019 B1 * 3/2002 Hutcherson et al. ..... 313/631
6,432,325 B1 * 8/2002 Hamada et al. ..... 252/518.1

(Continued)

FOREIGN PATENT DOCUMENTS

GB 569685 6/1945

*Primary Examiner*—Sikha Roy
*Assistant Examiner*—Jose M Diaz
(74) *Attorney, Agent, or Firm*—Mary Louise Gioeni

(57) ABSTRACT

An all-metal electron emissive structure for low-pressure lamps is disclosed. The all-metal electron emissive structure consisting of one or more metal is operable to emit electrons in response to a thermal excitation, wherein an active region of the electron emissive structure under steady state operating conditions has a temperature greater than about 1500 degree K, and wherein the cathode fall voltage in the discharge medium under steady state operating conditions is less than about 100 volts. A lamp including an envelope, an electrode including the all-metal electron emissive structure, and a medium, is also disclosed.

32 Claims, 7 Drawing Sheets

U.S. PATENT DOCUMENTS

| | | | | |
|---|---|---|---|---|
| 6,809,477 | B2 * | 10/2004 | Soules et al. | 313/631 |
| 6,825,613 | B2 * | 11/2004 | Chow et al. | 313/558 |
| 6,853,124 | B1 | 2/2005 | Vollkommer et al. | |
| 7,075,232 | B2 * | 7/2006 | Maseki et al. | 313/512 |
| 7,358,675 | B2 * | 4/2008 | Yamashita et al. | 313/631 |
| 7,429,826 | B2 * | 9/2008 | Kawai | 315/94 |
| 2003/0102805 | A1 * | 6/2003 | Hataoka et al. | 313/623 |
| 2003/0151350 | A1 * | 8/2003 | Xu | 313/485 |
| 2004/0051453 | A1 * | 3/2004 | Chow et al. | 313/558 |
| 2004/0232820 | A1 * | 11/2004 | Jansma | 313/486 |
| 2004/0239253 | A1 * | 12/2004 | Walser et al. | 313/618 |
| 2005/0057143 | A1 * | 3/2005 | Chow et al. | 313/492 |
| 2005/0077828 | A1 | 4/2005 | Haacke | |
| 2005/0077830 | A1 * | 4/2005 | Yamashita et al. | 313/637 |
| 2006/0087241 | A1 * | 4/2006 | Woffendin et al. | 313/623 |
| 2006/0208635 | A1 * | 9/2006 | Lenef et al. | 313/567 |
| 2007/0114941 | A1 * | 5/2007 | Garner et al. | 313/631 |
| 2007/0120482 | A1 * | 5/2007 | Michael et al. | 313/568 |
| 2008/0252216 | A1 * | 10/2008 | Takahashi et al. | 313/631 |

* cited by examiner

METAL ELECTRODES FOR ELECTRIC PLASMA DISCHARGE DEVICES

BACKGROUND

The invention relates generally to electrodes for electric plasma discharge devices.

Low-pressure metal halide electric discharge plasmas have the potential to replace the mercury electric discharge plasma in conventional fluorescent lamps. However, many conventionally used electron emission materials, such as barium oxide, are not chemically stable in the presence of a metal halide plasma. Although the applicants do not wish to be bound by any theory, it is believed, for example, that a barium oxide (BaO) electron emissive material may react with a metal halide (MeX, wherein Me is the metal and X is the halogen) vapor, such as indium iodide vapor present in a discharge medium, leading to the formation of barium halide (BaX) vapor and a condensed metal oxide (MeO). Other conventionally used electron emission materials, such as calcium oxide and strontium oxide, may be less reactive with metal halide vapors. However, most electron emissive materials are expected to react with the metal halide vapor to some degree.

Even in conventional mercury-based fluorescent lamps, reactions which occur between the electrode material and the discharge material (mercury) are disadvantageous. In particular, mercury can react or amalgamate with electron emissive materials such as barium oxide, or with reaction products of the emissive materials. It is believed that electrode material deposits are formed on the inner wall of the lamp, as the lamp ages, and the mercury in the discharge amalgamates with the electrode material that has deposited on the wall. After this reaction or amalgamation, the mercury is more strongly bound and cannot evaporate as easily from the wall during normal operation, and hence is effectively removed from participation in the light-generation mechanism of the lamp. Undesirably, additional mercury must be placed into the lamp during its manufacture, to compensate for the mercury that is effectively lost to reaction or amalgamation, and ensure that the lamp meets its rated operational life. The reaction and amalgamation of mercury can be managed through the use of shields, which can provide both a physical as well as a chemical barrier to the loss of mercury, but the addition of shields also adds undesirably to the cost and complexity of the lamp.

Metal electrodes, such as tungsten electrodes, without electron emissive material coatings, are known in the art for high-pressure high-intensity-arc-discharge (HID) lamps. Some non-thermionic metal electrodes are also known in the art for low-pressure discharge plasmas, but only when the electrodes are relatively cold, below their thermionic electron emission temperature (for example, less than 1500 degree K). In the case of non-thermionic metal electrodes, the electrons are emitted from the electrode by "secondary electron emission" (in response to an incident high-energy ion, where typically the ion energy is 100-150 electron volts), or photoelectron emission (in response to a photon of sufficiently high energy). Such "cold cathodes" are used in neon signs and in "cold cathode fluorescent lamps" for display backlights, but because of the high cathode-fall voltage, the lamp discharge voltage is typically very high (>1 kV) to achieve good device efficiency. For general lighting, hot-cathode fluorescent lamps are commonly used instead of cold-cathode lamps, because of their higher efficiency and lower operating voltage.

Therefore there is a need for an electrode design which addresses one or more of the foregoing problems with electrodes used in low-pressure plasma discharge devices.

BRIEF DESCRIPTION

In one aspect of the present invention is an all-metal electron emissive structure consisting of one or more metals, wherein the electron emissive structure is operable to emit electrons in a discharge medium in response to a thermal excitation, wherein an active region of the electron emissive structure under steady state operating conditions has a temperature greater than about 1500 degree K, wherein the discharge medium under steady state operating conditions produces a total pressure less than about $1\times10^5$ Pascals, and wherein the cathode fall voltage in the discharge medium under steady state operating conditions is less than about 100 volts.

In another aspect of the present invention is an electrode including an all-metal electron emissive structure consisting of one or more metals, wherein the electron emissive structure is operable to emit electrons in a discharge medium in response to a thermal excitation, wherein an active region of the electron emissive structure under steady state operating conditions has a temperature greater than 1500 degree K, wherein the discharge medium under steady state operating conditions produces a total pressure less than about $1\times10^5$ Pascals, and wherein the cathode fall voltage in the discharge medium under steady state operating conditions is less than about 100 volts, and a supporting structure for the all-metal electron emissive structure.

In still another aspect of the present invention is a lamp including an envelope, a discharge medium disposed within the envelope, and an electrode, wherein the electrode comprises an all-metal electron emitting structure, wherein the electron emissive structure is operable to emit electrons in a discharge medium in response to a thermal excitation, wherein an active region of the electron emissive structure under steady state operating conditions has a temperature greater than 1500 degree K, wherein the discharge medium under steady state operating conditions produces a total pressure less than about $1\times10^5$ Pascals, and wherein the cathode fall voltage in the discharge medium under steady state operating conditions is less than about 100 volts.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
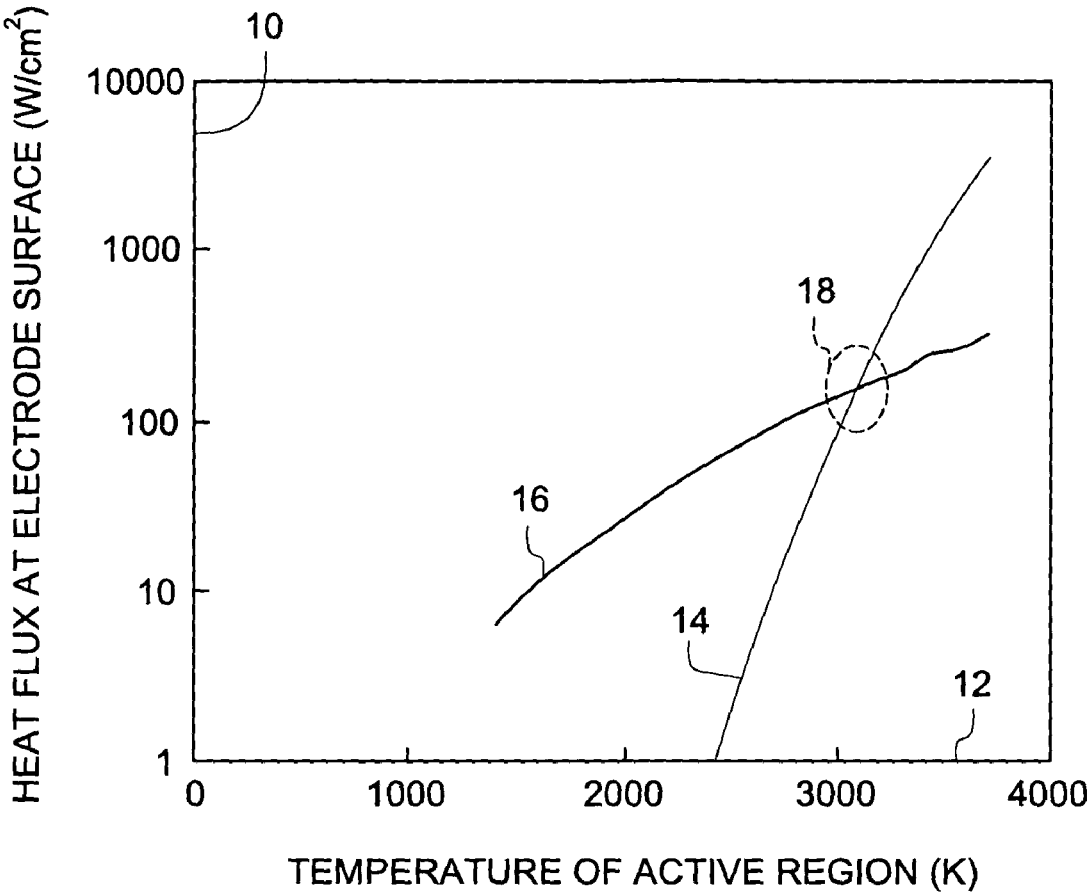
FIG. 1 is a graphical representation of the variation in cooling and heating fluxes versus temperature of the active region of an all-metal electron emissive structure, in accordance with certain embodiments of the present invention.

Embodiments of the present invention include all-metal electron emitting structures and plasma discharge devices including such electron emitting structures.

Metals, such as refractory metals including tungsten, have a higher work function (greater than 4 eV) relative to conventional oxide-electron emissive materials, and consequently have to be operated at higher temperatures to emit the desired level of electrons in low-pressure discharge environments. To heat such metals to their thermionic temperature, the cathode fall voltage may have to be increased to increase the bombardment of higher energy ions on the cathode. If the cathode fall voltage is too high the incident ions will bombard the electrode surface and physically destroy the electrode by sputtering or otherwise removing material from the electrode surface. Another mechanism, which may also lead to damage of the electrode, is ion-impact-assisted etching. If all-metal electron emissive structures were to be designed in the shape of conventional electrode structures known in the low-pressure plasma discharge device art, the structures would dissipate heat at levels not useable in low-pressure discharge environments. Embodiments of the present invention include smaller, heat-conserving, all-metal electron emissive structures for low-pressure plasma discharge devices that may be brought to thermionic temperature with less total heat input.

In accordance with one embodiment of the present invention an all-metal electron emissive structure consisting of one or more metals is described, wherein the electron emissive structure is operable to emit electrons in response to a thermal excitation. As used herein, the term "all-metal" refers to a structure consisting of only metals, mixtures of metals, alloys of metals, without the presence of any metal compounds such as metal oxides, in which all reasonable measures are taken during manufacture to avoid the presence of metal compounds in the electron emissive structure. The electron emissive structure under steady state operating conditions may be configured to have an active region with balanced heating and cooling fluxes. As used herein, the term "active region" refers to the surface with area A at the interface between a gaseous plasma region (hereinafter referred to as the "gas") and the hot, electron-emitting portion of the electron emissive structure (hereinafter referred to as the solid), when the electron emissive structure is used in a plasma discharge device. Electrons are emitted from the solid into the gas.

Although the applicants do not wish to be bound by any particular theory, the following analysis is presented to provide a method for configuring an all-metal electron emissive structure to have desirable thermionic properties. That is, heat and current transfer are continuous at the surface that separates the gas from the solid, and at the same time the cathode fall voltage is low, so as to decrease damage caused by incident ions and increase operating life.

As will be described in further detail below, the electron emissive material properties and gas material properties may be used to configure the electron emissive structure to have an active region with desirable thermionic properties. For example, thermal-radiative emittance of the active region of the electron emissive structure surface e, work function of the electron emissive structure surface $\phi$, ionization threshold of the gas $V_{ion}$, and electron temperature at the boundary between the cathode fall and the bulk plasma, expressed in energy units $T_e$, may be used to configure the electron emissive structure to have an active region with desirable thermionic properties The active region may be cooled by at least three thermal transport channels: conduction (to both the gas and the remainder of the electron emissive structure structure), convection (to the surrounding gas), and thermal radiation (to the surrounding structures, which may include other parts of the electron emissive structure itself).

To estimate the thermal radiative cooling of the active region, the thermal radiative emission $P_{rad}$ may be calculated.

$$P_{rad}=\epsilon\sigma T^4, \tag{1}$$

where $\epsilon$ is the thermal emittance of the active region material, $\sigma$ is the Stefan-Boltzmann constant ($5.67\times10^{-12}$ W cm$^{-2}$ K$^4$), and T is the active region material temperature. For example, the emittance of metals like tungsten is typically 0.2-0.4, so the thermal-radiative cooling of the active region ranges from 6 to 425 W/cm$^2$ for temperatures in the range 1500 K to 3700 K. For example, the active region may also include the immediately underlying solid bulk material. The temperature in the active region may be assumed to be uniform or the temperature distribution in the active region may also be taken into account.

To consider additional heating and cooling mechanisms that are active when the structure is operating as a cathode in a plasma environment, the gas volume may be separated into two analysis regions: (i) the "cathode fall" region, a thin layer immediately adjacent to the electrode surface, and (ii) the "bulk plasma" region beyond the cathode fall. The "bulk plasma" may in fact be any of the regions of a discharge plasma, such as the presheath or negative glow or positive column. The "bulk plasma" may be treated as a quasineutral region with known plasma parameters, where the electric field strength is low. The bulk plasma contrasts with the cathode fall, where the net charge density is high and positive, and the electric field strength is comparatively large. The bulk plasma as a whole is the region that determines the properties of the device, such as the total current, and the efficiency of conversion of electricity into light (for a lamp). The calculations follow methods commonly used in the art to analyze the interaction of plasmas with electrodes and other boundaries.

The heating flux q to the active region when the electrode is operating as a cathode (i.e. negative with respect to the bulk plasma) is given by $$q=j_i(V_{ion}-\phi)+j_i(V_{CF}+5T_e/2)-j_e\phi, \quad (2)$$

where $j_i$ is the ion current density (A/m$^2$), $j_e$ electron current density, $V_{CF}$ is the cathode fall voltage. The cathode fall voltage is the difference in electric potential between the surface and the bulk plasma. $T_e$ is the electron temperature at the boundary between the cathode fall and the bulk plasma, expressed in energy units. Equation 2 can also be written in terms of the total current j and the parameter $f_i$, the fraction of current in the gas at the electrode surface that is carried by the ions:

$$q=j[f_i(V_{ion}+V_{CF}+5T_e/2)-\phi]. \quad (3)$$

The heating flux q should be sufficiently high to raise the active region to the proper temperature for thermionic emission, and offset the thermal-radiative cooling at that temperature.

The Richardson equation may be used to estimate the electron emission current density at the electrode surface. A simple form of the thermionic electron current emitted from the active region is given by $$j_e=A_R T^2 e^{-\phi T} \quad (4)$$

where T is the temperature of the active region. In one example, material (tungsten) and plasma parameters in Equation (3) are used to generate distributions for both heat loss and heating flux.

FIG. 1 is a plot of the heat flux (10) at electrode surface versus operating temperatures (12) for the active region of a tungsten electron emissive structure, operating in a gallium iodide plasma, where the ionization threshold $V_{ion}$ is equal to 6 V, the cathode fall voltage VCF is 13 volts, $T_e$ is equal to 0.8 electron volts, and the ion current fraction at the cathode surface is $f_i$=0.5. The active region configuration is satisfied where the heating and cooling fluxes balance, where the curves 14 and 16, represent cooling and heating fluxes respectively, intersect (18) near a temperature of 3100 K as seen in FIG. 1 for a tungsten electron emissive structure. A similar analysis using the properties of tantalum leads to an estimate of 2900 K as the temperature at which the active region configuration is satisfied. In further embodiments of the present invention, various combinations of the parameters j, $f_i$, and VCF may be used to satisfy the requirement that the heat and current transfer match at the surface of the active region, q=$P_{rad}$ and jA=I, where A is the surface area of the active region, and I is the total device current. The analysis shown here is for an embodiment wherein the plasma discharge device is operated in the direct-current mode, and the equations balance when the electrode is acting as a cathode, to attract positive ions. In alternative embodiments, where the device may run in an alternating current mode, each electrode acts as a cathode for half the time, and an anode for the other half, so the heat flux is effectively halved, even though the cooling mechanisms operate continuously. Alternating current as used herein may have any waveshape, sinusoid, square, triangle, or some general periodic shape. The electrode may be heated by interaction with the plasma during the anode portion of an alternating current cycle. Any heating delivered during the anode portion of the alternating cycle may be expected to reduce the heating requirements during the cathode portion of the cycle. Anode heating is mostly nondestructive, as no energetic positive ions impact the electrode surface. Although anode heating may be destructive if it overheats the electrode structure, which may be avoided by proper thermal design.

Table 1 is a comparative listing of electron emissive structure parameters for low-pressure discharge electrodes of the present invention with known types of electrodes. Compared with the prior art, embodiments of the present invention operate at a much higher heat flux to the surface, so that the surface can be heated to high temperature without the need for destructive heating mechanisms, and can supply sufficient current density and total current from the emitting surface. The operating temperature, heat flux, and emission current density are all higher than in conventional low-pressure discharge devices.

TABLE 1

Electrode parameters

| Electrode structure | Thermionic tungsten electrode | Triple oxide-tungsten electrode | Cold cathode tungsten |
|---|---|---|---|
| Estimated work function of emitting surface | 4.5 eV | 2.2 eV | 4.5 eV |
| Estimated temperature of active region | 3100 K | 1400 K | 300 K |
| Estimated current density of emitting surface | 30 A/cm$^2$ | 3 A/cm$^2$ | 0.003 A/cm$^2$ |
| Estimated area of active region to supply a typical current of 0.3 A | 1 mm$^2$ | 10 mm$^2$ | 10000 mm$^2$ |

Figure 2:
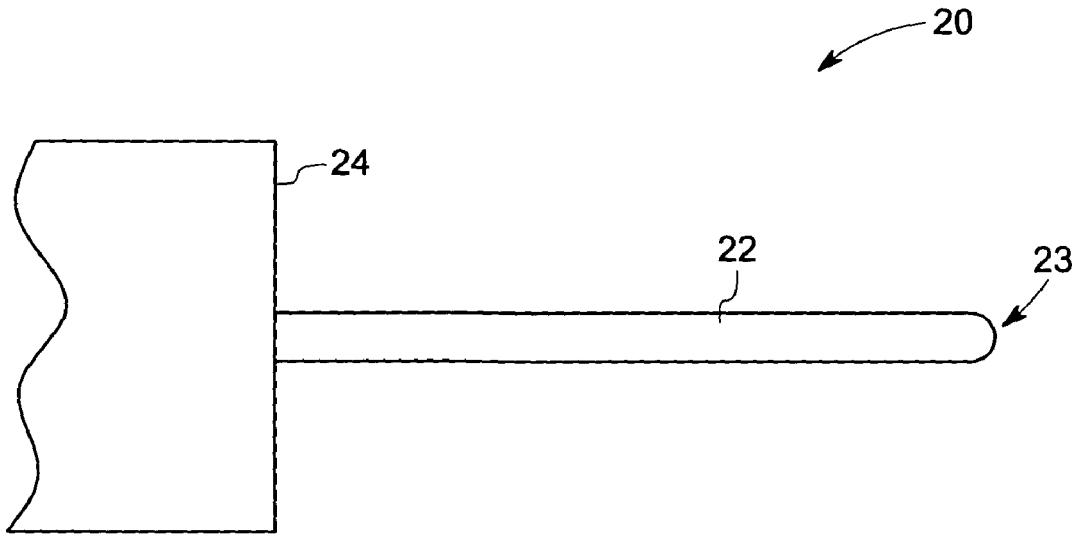
FIG. 2 is a representative view of an all-metal electron emissive structure in accordance with certain embodiments of the present invention.

In one embodiment of the present invention as illustrated in FIG. 2, the all-metal electron emissive structure 20 includes a rod-like or wire-like structure 22. The electron emissive structure 20 is supported on a supporting structure 24. In some embodiments, the free end 23 of the rod-like electron emissive structure may be flat, while in other embodiments may be curved. In some embodiments, the supporting structure is made of metal, in other embodiments the supporting structure may be made of glass or silica. In one embodiment of the present invention, a supporting structure material may be selected considering factors such as but not limited to their reactivity in the discharge medium and the evaporation rate. For example a supporting structure of nickel may be used with an electron emission structure including tungsten. The nickel supporting structure would typically be expected to withstand a temperature of 1500 degree K. Fusing a tungsten rod or wire-like electron emissive structure into a glass may lead to cracks in the glass during operation due to differential thermal expansion between tungsten and glass. In one example, if an electron emissive structure including a rod of tungsten is used in a discharge device with an envelope made of glass such as soda-lime or lead-alkali silicate glass, then a wire that is compatible with the thermal expansion properties of glass, such as made of copper-coated nickel-iron alloy, may be used as part of the support structure. During operation, the glass-metal joint is expected to be at lower temperature than the active region, therefore the choice of metals for use in the supporting structure is much wider than what is available for the active region. In another example, a lamp includes an electron emissive structure including a tungsten rod and an envelope of vitreous silica. The tungsten rod is welded to a thin molybdenum foil. The vitreous silica is sealed around the foil during manufacturing by any one of several known processes, where the vitreous silica is heated and then pinched or shrunk to make intimate contact with the foil. The foil is typically thin enough such that that it deforms plastically during heating and cooling, and the total stresses are kept low enough such that the silica does not crack.

Figure 3:
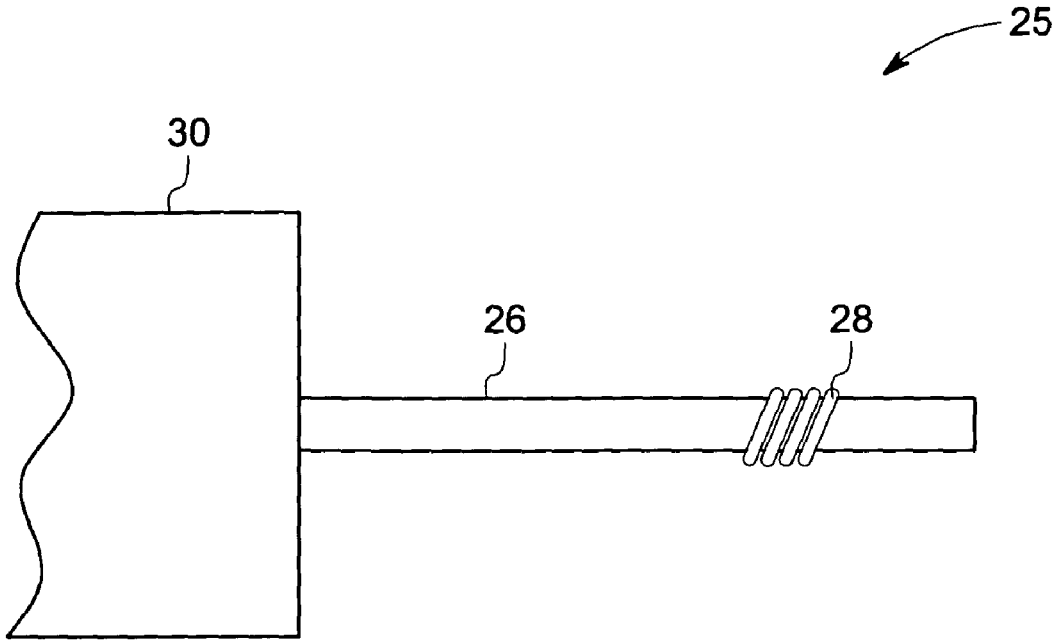
FIG. 3 is a representative view of an all-metal electron emissive structure in accordance with certain embodiments of the present invention.
Figure 4:
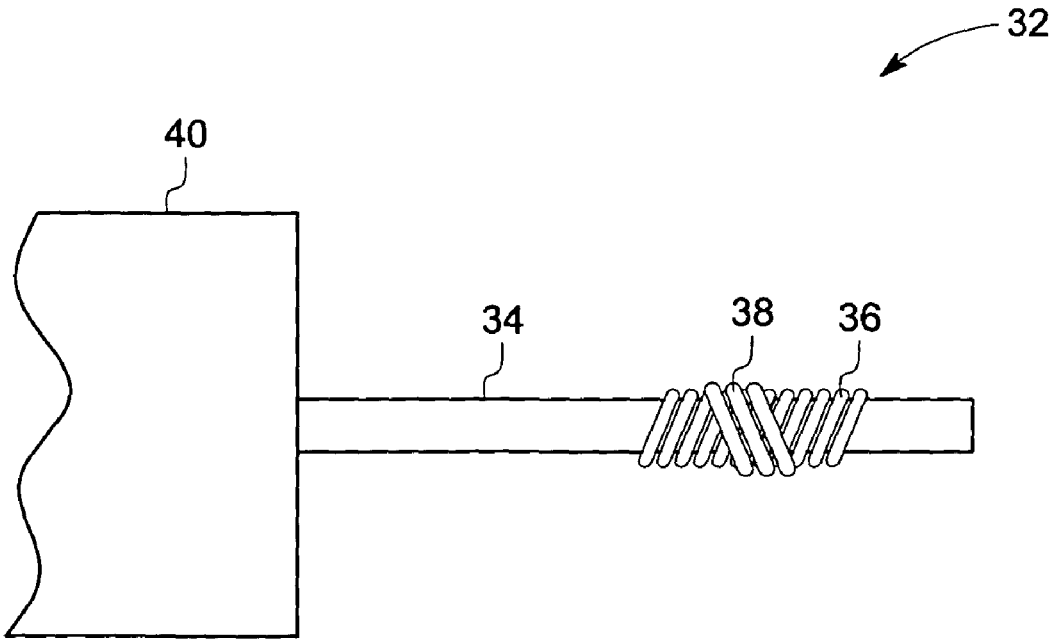
FIG. 4 is a representative view of an all-metal electron emissive structure in accordance with certain embodiments of the present invention.

FIGS. 3 and 4 illustrate embodiments of the electron emissive structure similar to the embodiment shown in FIG. 2, but which in addition have overwinds of metal wire to assist in lamp starting and provide additional degrees of freedom to manage the thermal profile and the dynamics of electron emission. In FIG. 3, an electron emissive structure 25 is shown to include a rod or wire 26 with an overwind 28. The structure is supported on a supporting structure 30. In FIG. 4, an electron emissive structure 32 is shown to include a rod or wire 34 with a dual overwind structure including overwinds 36 and 38.

Figure 5:
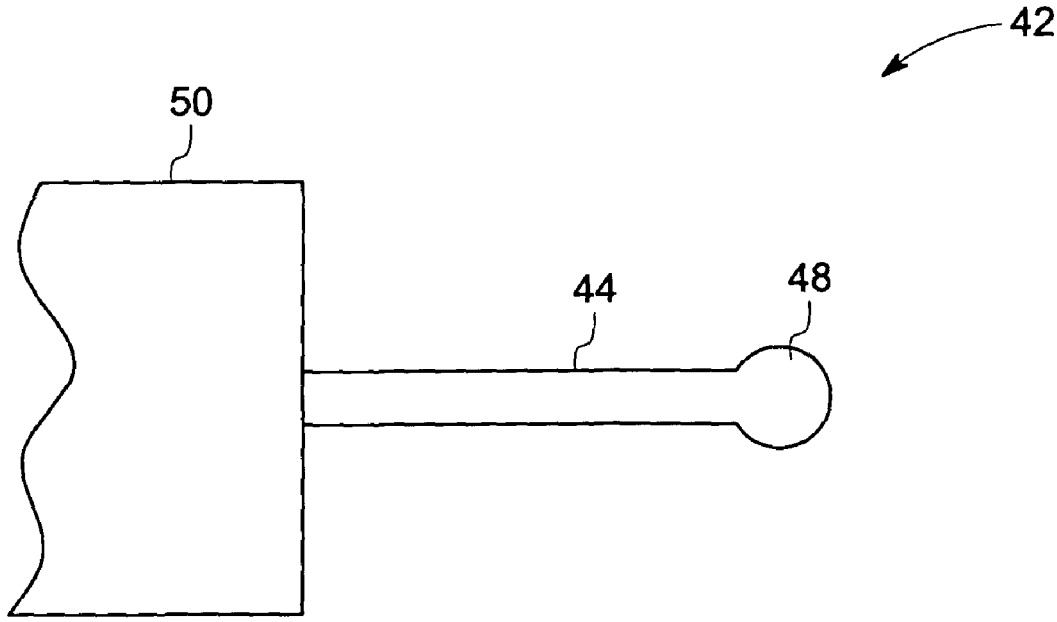
FIG. 5 is a representative view of an all-metal electron emissive structure in accordance with certain embodiments of the present invention.
Figure 6:
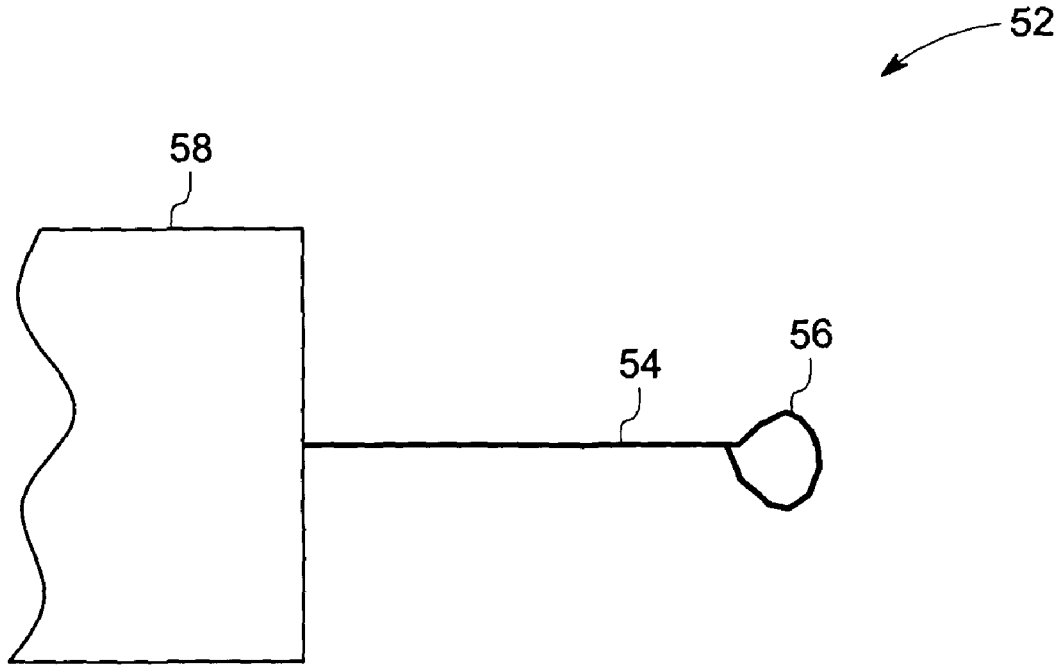
FIG. 6 is a representative view of an all-metal electron emissive structure in accordance with certain embodiments of the present invention.

In another embodiment of the present invention as illustrated in FIG. 5, the all-metal electron emissive structure 42, includes a unitary structure including a rod or wire 44 with a tip 48. The tip 48 may be spherical in shape as shown in FIG. 5 or have a more flattened structure. The electron emissive structure 42 is supported on a supporting structure 50. In another embodiment of the present invention as illustrated in FIG. 6, the electron emissive structure 52 includes a wire 54 bent into a loop 56 at the free end of the structure and doubled onto itself. The wire is supported by the supporting structure 58.

Figure 7:
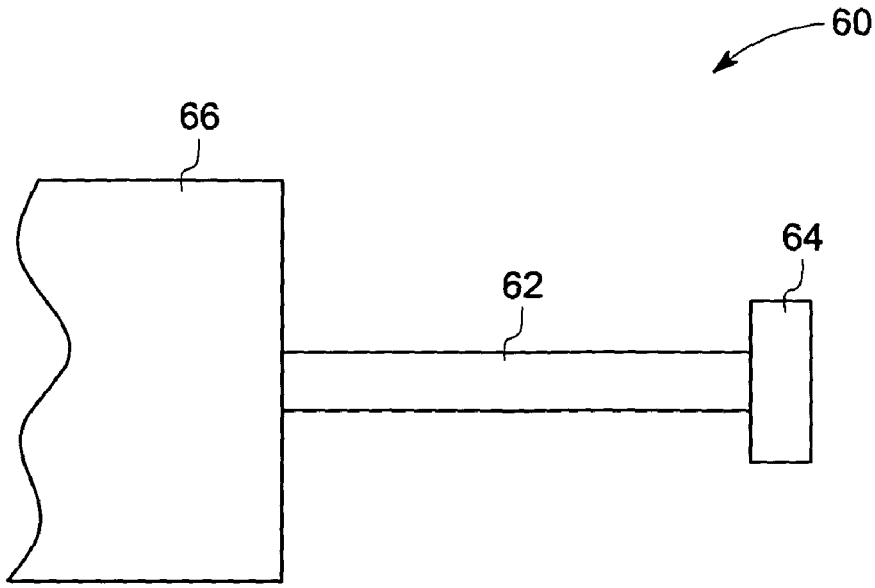
FIG. 7 is a representative view of an all-metal electron emissive structure in accordance with certain embodiments of the present invention.
Figure 8:
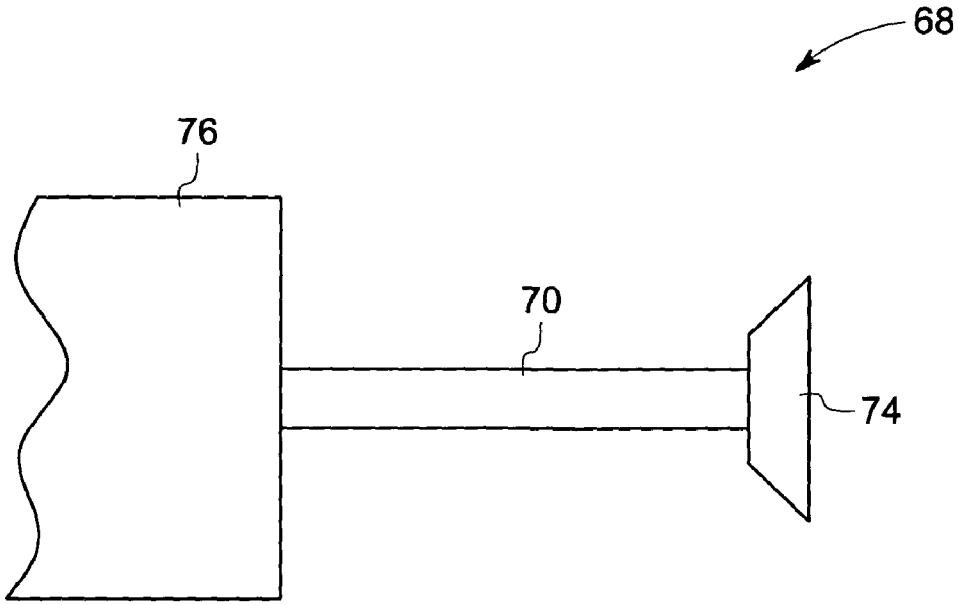
FIG. 8 is a representative view of an all-metal electron emissive structure in accordance with certain embodiments of the present invention.

Alternatively, as shown in FIG. 7, the electron emissive structure 60 includes a shaft 62 with a head 64 with a width wider than the shaft it is mounted on. The head 64 may have a bar or plate like structure as shown in FIG. 7 or a more curved or spherical structure. The structure may be supported on the supporting structure 66. In some embodiments the shaft and the head may be sub-structures joined together. In certain embodiments the shaft and head may be made of the different materials. In yet another embodiment of the present invention, the electron emissive structure 68 may be as shown in FIG. 8 with a shaft 70 and a filled cup shaped head 74. The head 74 may be a unitary structure of a single metal or may include an outer cup made of one or more metals and an inner filling of one or more metals. The shaft 70 may be mounted on a supporting structure 76.

Figure 9:
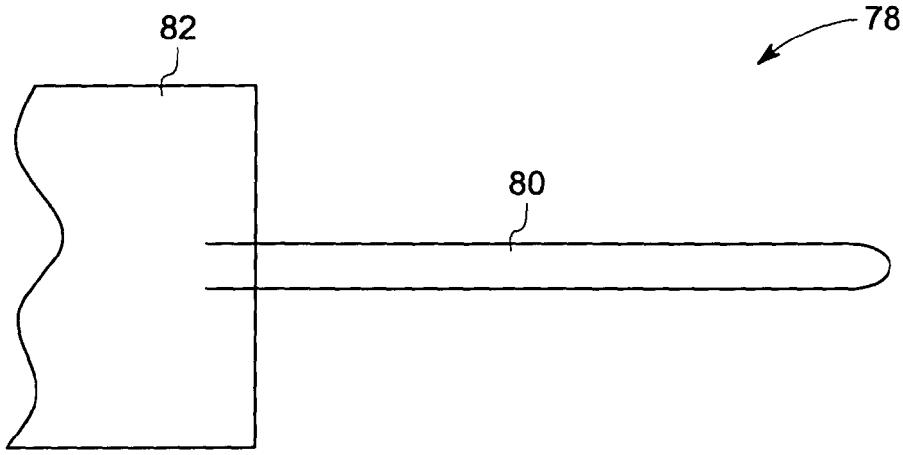
FIG. 9 is a representative view of an all-metal electron emissive structure in accordance with certain embodiments of the present invention.
Figure 10:
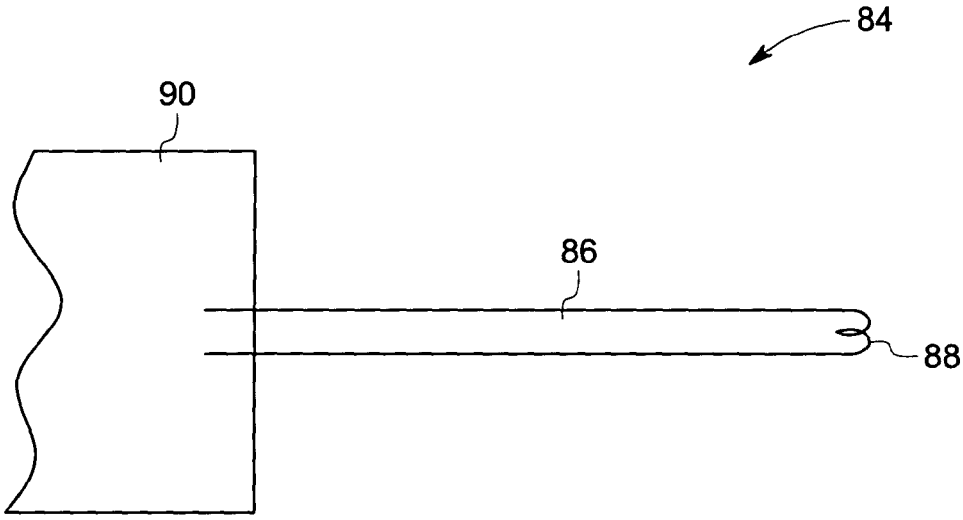
FIG. 10 is a representative view of an all-metal electron emissive structure in accordance with certain embodiments of the present invention.
Figure 11:
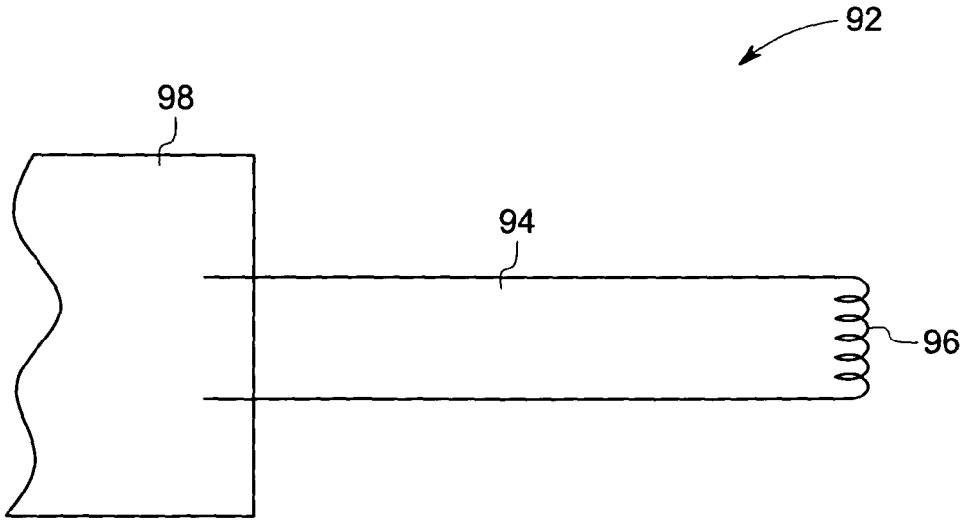
FIG. 11 is a representative view of an all-metal electron emissive structure in accordance with certain embodiments of the present invention.

As shown in FIG. 9, the electron emissive structure 78 may include a wire 80 bent to form a loop-like structure. The loop may be supported on a supporting structure 82. In yet another embodiment as illustrated in FIG. 10 the electron emissive structure 84 may include a coiled wire 86 with a turn of the wire 88. One end of the coiled wire may be supported by the supporting structure 90. FIG. 11 illustrates a similar embodiment of the electron emissive structure 92 including a coiled wire 94 with a plurality of turns 96, mounted on a support structure 98.

In some embodiments the electron emissive structure may include two or more sub-structures with one or more metals independently or in combination being present in each sub-structure. In still other embodiments the electron emissive structure may have a multilayered structure. Some metals may be chemically attacked by certain discharge compositions such as halogen vapor. In one embodiment, the structure may include a metal substrate with a metal coating. For example, a tungsten structure may be coated with rhenium.

In one embodiment of the present invention, the one or more metals included in the electron emissive structure are selected from the group of transition and rare-earth metals. In one embodiment of the present invention, the metal selection is dependent on the discharge medium the electron emissive structure is expected to operate in. In a chemically less reactive atmosphere, such as argon-mercury, the work function, melting point, vapor pressure, evaporation rate of the electrode material are some of factors determining the material selection for the electron emissive structure rather than chemical reactions with the gas and removal of the reaction products.

In a more reactive atmosphere, such as a metal halide discharge medium, the reactivity of the one or more metals used in the electron emissive structure along with other factors such as but not limited to the work function, melting point, vapor pressure, evaporation rate of the electron emissive structure material are used to select the electron emissive structure material.

In a non-limiting example, as a first step to determining a metal for use in an electron emissive structure operable in a halide environment, metals such as Ti, V, Cr, Mn, Fe, Co, Ni, Zr, Nb, Mo, Hf, Ta, W, Re, Gd, Dy, Er, Tm, Th, with known work functions are selected so heat flux calculations can be performed.

In a following step, for example, the reactivity of the metal in an iodine atmosphere may be assessed by determining the partial pressure of the metal halide at 1500 K gas with a gas discharge composition to what may be present in a low-pressure gallium iodide lamp operating near its highest radiant efficiency. For example, a cutoff threshold for the partial pressure of the metal compounds may be chosen to be 0.1 millitorr, which may lead to selection of metals including Fe, Co, Ni, Nb, Mo, Ta, W, and Re.

In another step in the process of metal selection, the operating temperatures required to provide a nominal current emission, for example 10 $A/cm^2$ may be determined using the equation 4 along with a determination of whether the metal is a solid at that temperature. This may lead to the selection metals such as Mo, Ta, W, and Re.

The flux calculations may be rerun at the required operating temperatures and a further selection of metals based the partial pressure at the operating temperatures may be performed to select the metal or metals for use in all-metal electron emissive structures in low-pressure discharge environments. In a non-limiting example the metals selected for use may be W and Ta.

In one embodiment, the one or more metals in the all-metal electron emissive structure have a vapor pressure under standard operating temperature of less than 0.1 Pascals. In a further embodiment, the one or more metals have a vapor pressure under standard operating temperature of less than 0.01 Pascals. In a non-limiting example, the vapor pressure of tungsten vapor over a condensed phase of tungsten, is about 0.01 Pascals at a active region temperature of about 3100 K, which is the temperature at which the heating and cooling flux balance. In another non-limiting example, the vapor pressure of tantalum vapor over a condensed phase of tantalum is about 0.01 Pascals at 2900 K active region temperature. In a further embodiment of the present invention, two or more metals may be alloyed such that the total vapor pressure above a condensed phase of the alloy is lower than the vapor pressure of any single component of the alloy over a condensed phase of itself.

One of the factors that may adversely affect the life of a lamp is the total rate of material removal from the electrode. The removal rate of one or more metals from the electron emissive structure during operation is proportional to the product of the area of the active region and the thermodynamic vapor pressure of the material. It is therefore desirable to reduce the surface area of the active region, so as to reduce the total rate of material removal, and improve the operational life of a lamp. A lower rate of material removal may also desirably reduce the accumulation of material on the inner surface of the envelope, where it can form an absorbing or reflecting film and reduce light output. During operation, if material is removed from the electrode, the location of the active region continuously adjusts itself so as to provide about the same current density and surface area. Satisfactory operation will continue until enough material is removed from the electrode to cause a significant change in the thermal balance of the active region. Accordingly it is further desirable to lower the rate of material removal to prevent undesirable changes in the thermal properties of the electrode structure. In one embodiment of the present invention, the area of the active region may be less than about 10 $mm^2$. In a further embodiment of the present invention, the area of the active region may be less than about 1 $mm^2$. In a still further embodiment of the present invention, the area of the active region may be less than about 0.1 $mm^2$.

In one embodiment of the present invention, the cathode fall voltage in the plasma discharge device is less than about 100 volts. In a further embodiment, the cathode fall voltage is less than about 50 volts. In a still further embodiment, the cathode fall voltage is less than about 20 volts. In some embodiments, the cathode fall voltage is in a range from about 20 volts to about 10 volts. In some other embodiments, the cathode fall voltage is less than about 10 volts.

In one embodiment of the present invention, an electrode including an all-metal electron emissive structure may be used in an electric plasma discharge device. Non-limiting examples of electric plasma discharge devices include discharge lamps. In a further embodiment of the present invention, an electrode including the all-metal electron emissive structure is disposed within a lamp having an envelope and a discharge medium disposed within the envelope. Non-limiting examples of lamps suitable for use in accordance with teachings of the present invention include linear fluorescent lamps, compact fluorescent lamps, circular fluorescent lamps, mercury free lamps, and xenon lamps.

Plasma discharge devices typically include an envelope containing a gas discharge medium through which a gas discharge takes place, as well as two metallic electrodes that are sealed in the envelope. While a first electrode supplies the electrons into the discharge space, a second electrode provides the electrons with a path out of the discharge space, to complete the electric circuit with the power source. Discharge lamps are typically energized by an external current-limiting power supply or "ballast". Discharge devices may be energized either with direct current or with alternating current. In direct-current operation one electrode (the cathode) always supplies electron current, and the other always absorbs electron current (the anode). In alternating current operation, each electrode alternately functions as a cathode and then an anode as the external device alternates the polarity of the current through the device. Non-limiting examples of discharge devices include a discharge medium such as but not limited to rare gases such argon and neon. Other devices include materials such as mercury and metal halides, where the discharge medium may be present as both gas and condensed material, and the partial pressure of the mercury or metal halide during steady-state operation is several times higher than when the device is at room temperature.

Electron emission generally takes place via thermionic emission, although many physical processes contribute to electron emission, including the electric field at the surface (field emission, or field-enhanced thermionic emission), ion bombardment (ion-induced secondary electron emission), and photon bombardment (photoelectron emission). Here we use the term 'thermionic emission' to denote materials and conditions where the relatively high temperature (>1500 K) of the electron-emission material contributes a majority of the total electron current emitted by the cathode.

Discharge medium may include discharge materials such as buffer gases and ionizable discharge compositions. Buffer gases may include material such as but not limited to rare gases such as argon, neon, helium, krypton and xenon, whereas ionizable discharge compositions may include materials such as but not limited to, metals and metal compounds. In some embodiments, ionizable discharge compositions may include rare gases. Non-limiting examples of discharge materials suitable for use in a lamp equipped with an all-metal electron emissive structure may include metals, such as but not limited to Hg, Na, Zn, Mn, Ni, Cu, Al, Ga, In, Tl, Sn, Pb, Bi, Ti, V, Cr, Zr, Nb, Mo, Hf, Ta, W, Re, or Os or any combinations thereof. Other discharge materials suitable for use include rare gases such as but not limited to neon and argon. Still other discharge materials include but are not limited to compounds such as halides or oxides or chalcogenides or hydroxides or hydrides or organometallic compounds or any combinations thereof of metals such as but not limited to Hg, Na, Zn, Mn, Ni, Cu, Al, Ga, In, Tl, Ge, Sn, Pb, Bi, Ti, V, Cr, Zr, Nb, Mo, Hf, Ta, W, Re, or Os or any combinations thereof. Non-limiting examples of metal compounds include zinc halides, gallium iodide, gallium bromide, indiumbromide and indium iodide. In some embodiments, in metal halide discharge lamps, the metal and halogen may be present in a non-stoichiometric ratio. For example, in a gallium iodide lamp, iodine and gallium may be present in a molar ratio (I/Ga) equal to about 1/3. In another example, iodine and gallium may be present in a molar ratio (I/Ga) in a range greater than about 2 to less than about 3. In another example, the discharge is composed of one or more rare gases with mercury as the ionizable composition. In one embodiment, the lamp is a mercury lamp. In another embodiment, the lamp is a mercury-free lamp.

In one embodiment of the present invention, an all-metal electron emissive structure is operable in a discharge medium, wherein the discharge medium under steady state operating conditions produces a total vapor pressure less than about $1\times10^5$ Pascals. As used herein, the term "steady state operating conditions" refers to operating conditions of a lamp which is in thermal equilibrium with its ambient surroundings, and wherein a majority of radiation from the discharge comes from the ionizable discharge compositions. In some embodiments of the present invention, the discharge medium in a lamp under steady-state operating conditions produces a total vapor pressure of less than about $1\times10^5$ Pascals. Typically, the buffer gas pressure during steady-state operation is higher than when at ambient temperature. The pressure rise is proportional to the temperature rise in the device. For example, for a mercury based discharge medium, an increase of about 5% in the pressure of buffer gas is seen when the operating temperature is increased to 40° C. operating from a temperature of 25° C. (non-operational). In a non-limiting example, in a mercury-free discharge medium such as gallium iodide, about 25% increase in the pressure of buffer gas is seen when the operating temperature is increased to about 100° C. from a temperature of about 25° C. (non-operational) and about 100% increase in buffer gas pressure is seen at an operating temperature of about 275° C. for indium and zinc halides. In some embodiments, the discharge medium under steady-state operating conditions produces a total vapor pressure in a range from about 20 Pascals to about $2\times10^4$ Pascals. In some other embodiments, the discharge material under steady-state operating conditions produces a total pressure in a range from about 20 Pascals to about $2\times10^3$ Pascals. In some embodiments the discharge material under steady-state operating conditions produces a total pressure in a range from about of about $1\times10^3$ Pascals. In some embodiments, the partial pressure under steady state operating conditions of the ionizable discharge composition in the discharge medium is less than about $1\times10^3$ Pascals. Typically, ionizable discharge composition pressure during steady state operation is several times higher than it was when the lamp was at ambient temperature, and often orders of magnitude higher, as the vapor pressure depends exponentially on the temperature. In further embodiments, the partial pressure under steady state operating conditions of the ionizable discharge composition in the discharge material is in a range from about 0.1 Pascals to about 10 Pascals. In one embodiment, the lamp is a mercury lamp. In another embodiment, the lamp is a mercury free lamp. In a non-limiting example, the discharge material includes argon buffer gas and gallium iodide ionizable discharge composition. At an ambient temperature of 20° C., the total pressure is about 670 Pascals, primarily due to the buffer gas, and the partial pressure of the ionizable discharge composition is about $1\times10^{-4}$ Pascals. At steady state operating condition temperature of 100° C., wherein the conversion efficiency of electric power into radiation is high, at least 25 percent. The total pressure is about 1000 Pascal and the partial pressure of the ionizable discharge composition is about 1 Pascal.

Figure 12:
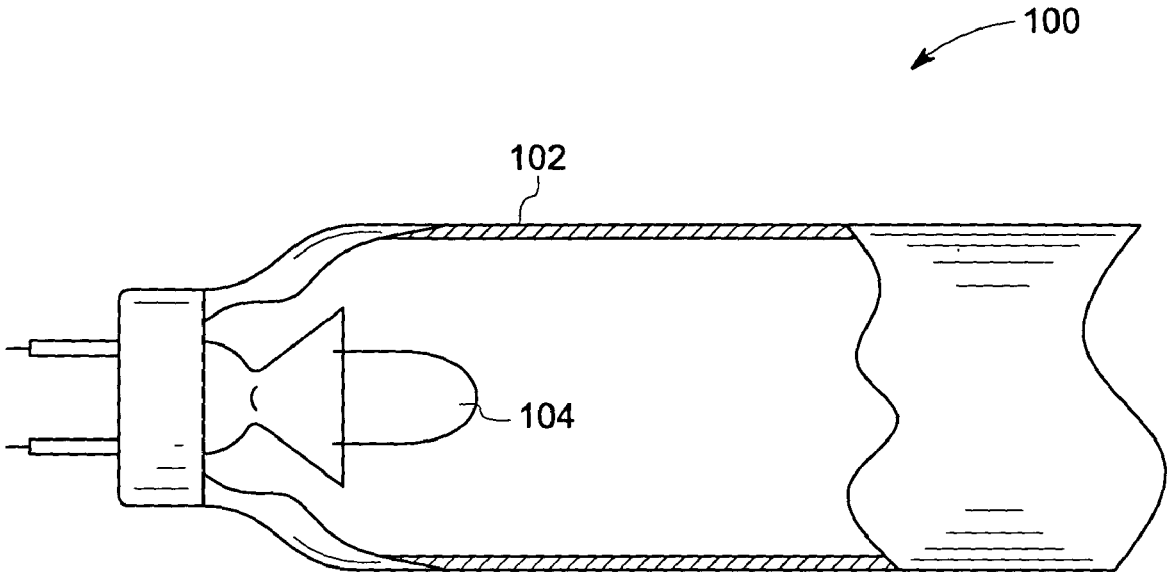
FIG. 12 is a cross-sectional view of a discharge lamp including an all-metal electron emissive structure in accordance with certain embodiments of the present invention.
Figure 13:
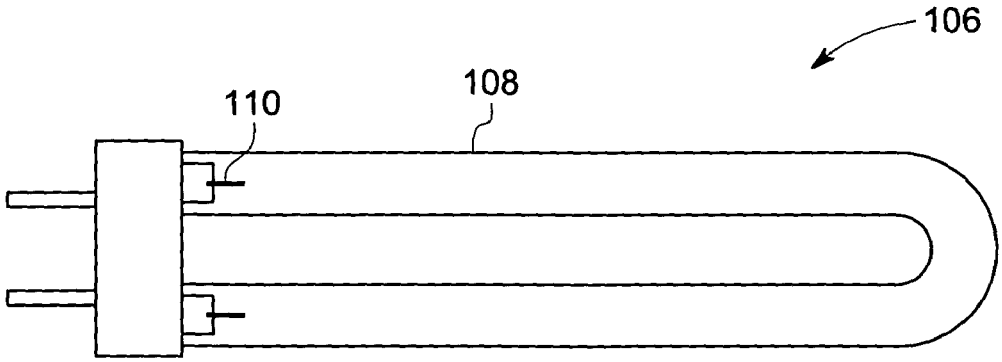
FIG. 13 is a cross-sectional view of a discharge lamp including an all-metal electron emissive structure in accordance with certain embodiments of the present invention.
Figure 14:
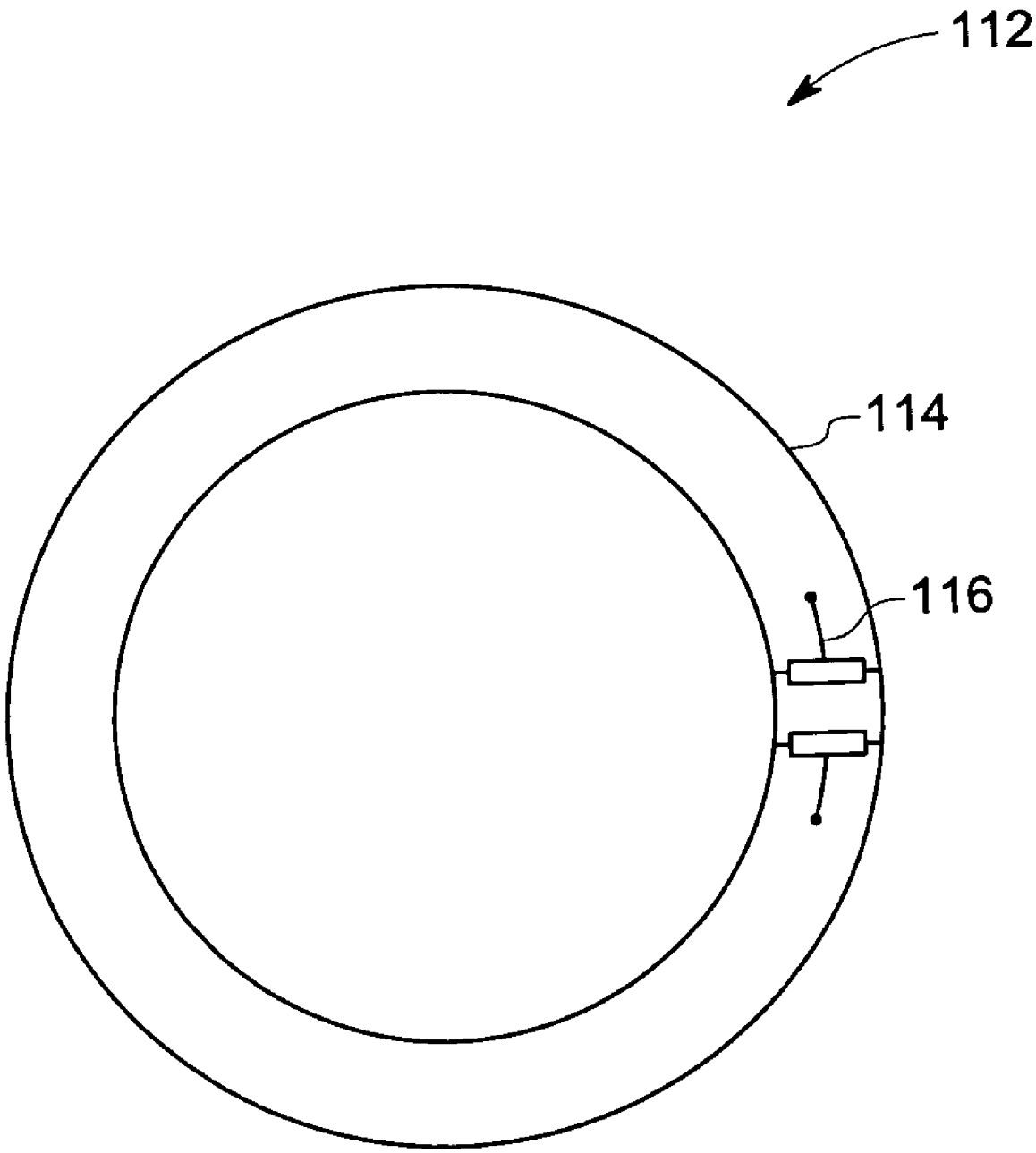
FIG. 14 is a cross-sectional view of a discharge lamp including an all-metal electron emissive structure in accordance with certain embodiments of the present invention.

In some embodiments, an all-metal electron emissive structure may be provided in a lamp including a cathode, a ballast, a discharge medium and an envelope or cover containing the discharge material. The lamp may optionally include one or more phosphors or phosphor blends. The lamp may comprise a linear lamp 100 as illustrated in FIG. 12 with an envelope 102 and an electrode with the all-metal electron emissive structure 104, or a compact lamp 106 with an envelope 108 and an electrode with the all-metal electron emissive structure 110 as illustrated in FIG. 13. The lamp may also be a circular lamp 112 with an envelope 114 and an electrode with the all-metal electron emissive structure 116, as illustrated in FIG. 14.

Without further elaboration, it is believed that one skilled in the art can, using the description herein, utilize the present invention to its fullest extent. The following examples are included to provide additional guidance to those skilled in the art in practicing the claimed invention. The examples provided are merely representative of the work that contributes to the teaching of the present application. Accordingly, these examples are not intended to limit the invention, as defined in the appended claims, in any manner.

EXAMPLE 1

In one example, an all-metal electrode is made for use in a discharge lamp. The electrode includes a tungsten rod-like or wire-like electron emissive structure as shown in FIG. 2. The electrode is used in a low-pressure plasma discharge device. The rod like electron emissive structure is designed and configured such that a plasma created in the discharge device attaches to the free end of the rod-like structure. In this example, the rod-like tungsten electron emissive structure has a diameter of about 0.3 mm, with a length of about 10 mm between the free end, where the plasma attaches, and the location where the structure makes good thermal contact with the lamp envelope. A lamp current of about 0.3 A is used to provide electron emission over an area of about 0.01 cm2. The plasma attaches to the free-end of the rod, as well as the sides of the wire, and extends back about 1 mm from the free-end. This 1 mm-long cylinder is the active region.

EXAMPLE 2

The electrode includes a tungsten, loop-like electron emissive structure as shown in FIG. 9. The electrode is used in a low-pressure plasma discharge device. As there are two paths of thermal conduction to lamp envelope, the conduction down each path is approximately half, relative to the rod-like electron emissive structure in example 1. In this example, the loop-like tungsten electron emissive structure has a diameter of about 2.1 mm. In such a configuration, a resistive heating current can be passed through the loop, from an external current source, to provide heat during lamp starting, or to increase the temperature during lamp operation, in comparison to operating conditions under which only the plasma supplies the heat flux.

EXAMPLE 3

A plasma discharge device using a vitreous silica or glass is made. The electron emissive structure-glass joint is designed such that residual conducted thermal power can pass from the wire, through the wire-glass joining area, and into the bulk of the silica or glass, consistent with a temperature in the bulk region that is equal to the envelope temperature. A design parameter which may be used for matching the heat transfer at the location where the metal rod enters the envelope is the diameter of the rod-like electron emissive structure.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. An electrode comprising:

a rod-like structure consisting of one or more metals, and having a tip comprising an active region that is operable to emit electrons in a discharge medium in response to a thermal excitation, wherein the tip has a surface area of less than about 10 $mm^2$, the active region under steady state operating conditions has a temperature greater than about 1500 degrees K, under steady state operating conditions the discharge medium produces a total pressure less than about $2\times10^4$ Pascals, and has a cathode fall voltage of less than about 100 volts.

2. The electrode of claim 1, wherein the discharge medium under steady state operating conditions produces a total pressure in a range from about 20 to about $2\times10^3$ Pascals.

3. The electrode of claim 1, wherein the cathode fall voltage in the discharge medium under steady state operating conditions is less than about 50 volts.

4. The electrode of claim 1, wherein the cathode fall voltage in the discharge medium under steady state operating conditions is less than about 20 volts.

5. The electrode of claim 1, wherein the one or more metals have a vapor pressure under standard operating conditions of less than about 0.1 Pascals.

6. The electrode of claim 1, wherein the one or more metals have a vapor pressure under standard operating conditions of less than about 0.01 Pascals.

7. The electrode of claim 1, wherein the area of the tip is less about 1 $mm^2$.

8. The electrode of claim 1, wherein the area of the tip is less about 0.1 $mm^2$.

9. The electrode of claim 1, wherein the active region under steady state operating conditions has a temperature greater than 2000 degree K.

10. The electrode of claim 1, wherein the active region under steady state operating conditions has a temperature greater than 2500 degree K.

11. The electrode of claim 1, wherein the one or more metals are selected from the group consisting of Fe, Co, Ni, Nb, Mo, Ta, W, Re, and combinations thereof.

12. The electrode of claim 1, wherein the one or more metals are selected from the group consisting of Mo, Ta, W, Re, and combinations thereof.

13. The electrode of claim 1, wherein the one or more metals are selected from the group consisting of Ta, W, and combinations thereof.

14. The electrode of claim 1, wherein the one or more metals are disposed independently or in any combination in one or more sub-structures.

15. The electrode of claim 14, wherein the sub-structure is a substrate.

16. The electrode of claim 14, wherein the sub-structure is a coating.

17. The electrode of claim 1, wherein the electrode comprises a shaft and a head.

18. The electrode of claim 1, wherein the electrode is disposed within an electric plasma discharge device.

19. The electrode of claim 1, wherein the one or more metals are selected from the group consisting of Ti, V, Cr, Mn, Fe, Co, Ni, Zr, Nb, Mo, Hf, Ta, W, Re, Gd, Dy, Er, Tm, Th, and combinations thereof.

20. A lamp comprising:

an envelope;

a discharge medium disposed within the envelope; and an electrode, wherein the electrode comprises, a rod-like structure with a tip having an active region that is operable to emit electrons in a discharge medium in response to a thermal excitation, wherein the tip has a surface area of less than about 10 $mm^2$, the active region under steady state operating conditions has a temperature greater than about 1500 degrees K, under steady state operating conditions the discharge medium produces a total pressure less than about $2\times10^4$ Pascals, and has a cathode fall voltage of less than about 100 volts.

21. The lamp of claim 20, wherein the discharge medium under steady state operating conditions produces a total pressure in a range from about 20 Pascals to about $2\times10^3$ Pascals.

22. The lamp of claim 20, wherein the cathode fall voltage in the discharge medium under steady state operating conditions is less than about 50 volts.

23. The lamp of claim 20, wherein the one or more metals are selected from the group consisting of Ti, V, Cr, Mn, Fe, Co, Ni, Zr, Nb, Mo, Hf, Ta, W, Re, Gd, Dy, Er, Tm, Th, and combinations thereof.

24. The lamp of claim 20, wherein the one or more metals are selected from the group consisting of Ta, W, and combinations thereof.

25. The lamp of claim 20, wherein the discharge medium comprises at least one metal selected from the group consisting of metals, Hg, Na, Zn, Mn, Ni, Cu, Al, Ga, In, TI, Sn, Pb, Bi, Ti, V, Cr, Zr, Nb, Mo, Hf, Ta, W, Re, Os, and combinations thereof.

26. The lamp of claim 20, wherein the discharge medium comprises at least one rare gas selected neon, argon, krypton, neon, xenon, and combinations thereof.

27. The lamp of claim 20, wherein the discharge medium comprises at least one metal compound, wherein the metal is at least one selected from the group consisting of metal compounds, compounds of Hg, Na, Zn, Mn, Ni, Cu, Al, Ga, In, TI, Ge, Sn, Pb, Bi, Ti, V, Cr, Zr, Nb, Mo, Hf, Ta, W, Re, Os, and combinations thereof.

28. The lamp of claim 27, wherein the metal compound comprises at least one compound selected from the group consisting of halides, oxides, chalcogenides, hydroxide, hydride, and organometallic compounds.

29. The lamp of claim 20, wherein the discharge medium comprises at least one material selected from the group consisting of gallium iodide, gallium bromide, zinc iodide, zinc bromide, indium iodide, indium bromide and combinations thereof.

30. The lamp of claim 20, further comprising a phosphor.

31. The lamp of claim 20, wherein the lamp comprises one selected from the group consisting of a linear fluorescent lamp, compact fluorescent lamp, and a circular fluorescent lamp.

32. The lamp of claim 20, wherein the lamp is a mercury lamp or a mercury free-lamp.

* * * * *